US006222930B1

(12) United States Patent
Nakano et al.

(10) Patent No.: US 6,222,930 B1
(45) Date of Patent: Apr. 24, 2001

(54) METHOD OF REPRODUCING SOUND

(75) Inventors: Kenji Nakano, Tokyo; Takashi Kanai; Kaneaki Fujishita, both of Chiba, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/014,060

(22) Filed: Jan. 28, 1998

(30) Foreign Application Priority Data

Feb. 6, 1997 (JP) ..... 9-023578

(51) Int. Cl.[7] ..... H04R 5/00; H04R 5/02

(52) U.S. Cl. ..... 381/307; 381/18; 381/17

(58) Field of Search ..... 381/307, 303, 381/304, 305, 300, 310, 1, 17, 18, 19, 21, FOR 124, 63

(56) References Cited

U.S. PATENT DOCUMENTS

| | | | | |
|---|---|---|---|---|
| 5,208,860 | * | 5/1993 | Lowe et al. | 381/17 |
| 5,404,406 | * | 4/1995 | Fuchigami et al. | 381/17 |
| 5,579,396 | * | 11/1996 | Iida et al. | 381/18 |
| 5,581,618 | * | 12/1996 | Satoshi et al. | 381/17 |
| 5,598,478 | * | 1/1997 | Tanaka et al. | 381/17 |
| 5,657,391 | * | 8/1997 | Jyosako | 381/1 |
| 5,680,464 | * | 10/1997 | Iwamatsu | 381/18 |
| 5,710,818 | * | 1/1998 | Yamato et al. | 381/1 |
| 5,799,094 | * | 8/1998 | Mouri | 381/17 |
| 5,822,438 | * | 10/1998 | Sekine et al. | 381/17 |
| 5,862,227 | * | 1/1999 | Orduna-Bustamante et al. | 381/17 |

FOREIGN PATENT DOCUMENTS

| | | | |
|---|---|---|---|
| 0430700 | 5/1992 | (JP) | H04S/1/00 |
| 6233394 | 11/1994 | (JP) | H04S/1/00 |

* cited by examiner

*Primary Examiner*—Xu Mei
(74) *Attorney, Agent, or Firm*—Jay H. Maioli

(57) ABSTRACT

A sound reproducing system in which virtual image orientation processing of audio signals for at least two rear speakers disposed in directions from a listener close to the right-back direction from the listener is performed by a virtual sound orientation processor so that the listener can have a sound image at a position different from each of real speaker positions at which the rear speakers are placed, and/or so that the listener is unconscious that sounds are radiated from the rear speakers placed at real speaker positions. This virtual image orientation processing is performed according to acoustic transfer coefficients of transfer of sounds from the rear speakers to the listener's ears when the rear speakers are placed at virtual speaker positions different from the real speaker positions.

12 Claims, 7 Drawing Sheets

| | |
|---|---|
| G1 | $H\theta 2R / (H\theta 1L \times H\theta 2R - H\theta 1R \times H\theta 2L)$ |
| G2 | $-H\theta 1R / (H\theta 1L \times H\theta 2R - H\theta 1R \times H\theta 2L)$ |
| G3 | $H\theta 1L / (H\theta 1L \times H\theta 2R - H\theta 1R \times H\theta 2L)$ |
| G4 | $-H\theta 2L / (H\theta 1L \times H\theta 2R - H\theta 1R \times H\theta 2L)$ |

| | |
|---|---|
| H1 | $\sum_{i=1} H\phi aLi = H\phi aL1 + H\phi aL2 + H\phi aL3 + H\phi aL4$ |
| H2 | $\sum_{i=1} H\phi aRi = H\phi aR1 + H\phi aR2 + H\phi aR3 + H\phi aR4$ |
| H3 | $\sum_{i=1} H\phi bRi = H\phi bR1 + H\phi bR2 + H\phi bR3 + H\phi bR4$ |
| H4 | $\sum_{i=1} H\phi bLi = H\phi bL1 + H\phi bL2 + H\phi bL3 + H\phi bL4$ |

METHOD OF REPRODUCING SOUND

BACKGROUND OF THE INVENTION

1. Field of the Invention

The present invention relates to a sound reproducing method and to an audio signal processing apparatus for use in, for example, a surround type sound reproducing system.

2. Description of the Related Art

For listening to, for example, sounds reproduced from a compact disk (CD), or for enjoying images and sounds obtained from a television program or reproduced from a video tape or a digital video disk (DVD) in a home listening room or the like, a particular sound reproducing system, e.g., a surround type sound reproducing system may be used, which is intended to enable reproduction of sounds with movie-theater or concert-hall presence.

FIG. 9 shows an example of such a surround type sound reproducing system. In this example, left and right speakers (surround speakers) 30*a* and 30*b* are provided in addition to left and right front speakers and are placed at the rear of a listener 100.

Audio signals are reproduced in an audio signal source 10, which is a reproducing unit such as a CD player. Of these signals, a left-channel audio signal AL and a right-channel audio signal AR are respectively amplified by amplifier circuits 11*a* and 11*b*, and are output from these amplifiers to the speakers 20*a* and 20*b*.

In this example, an audio signal S1*a* for the left rear speaker is amplified by an amplifier circuit 12*a* to be supplied to the left rear speaker 30*a* while an audio signal S1*b* for the right rear speaker is amplified by an amplifier circuit 12*b* to be supplied to the right rear speaker 30*b*.

Rear speaker sounds are radiated from the rear speakers 30*a* and 30*b* in addition to those from the speakers 20*a* and 20*b*, thereby enabling the listener 100 to hear the reproduced sounds with certain original-sound presence.

In ordinary sound reproducing systems using two rear speakers in this manner, the opening angle θ between a front-rear axis on the listener 100 and a line extending from the listener 100 to the left rear speaker 30*a* along a horizontal plane, and the opening angle θ between the front-rear axis and a line extending from the listener 100 to the right rear speaker 30*b* along the horizontal plane are set to about 110°.

This is because 110° is recommended as the opening angle θ with respect to the Dolby Prologic system, the Dolby AC3 system, the MPEG multichannel system and so on.

With the conventional sound reproducing system using two rear surround speakers, for example, as shown in FIG. 9, a listener is liable to be clearly conscious of the existence of the rear speakers. In a situation where a listener can clearly sense that a sound is being radiated from the rear speakers, he or she has, in the ambiance of the sound field including the sound radiated from the rear speakers, a feeling of lack of spacing from the sound sources by attraction to the rear speakers. As a result, the surrounding reproduction effect is considerably reduced.

SUMMARY OF THE INVENTION

In view of these circumstances, an object of the present invention is to provide a sound reproducing method and an audio signal processing apparatus which make it possible to solve the problem of the existence of rear speakers being sensed by a listener when a sound is radiated from the rear speakers.

To achieve the above-described object, according to the present invention, there is provided a method of reproducing sound comprising the steps of processing, by virtual image orientation processing, sound signals to be supplied to at least two rear speakers so that a listener can have a sound image at a position different from each of real speaker positions at which the rear speakers are placed, or so that the listener is unconscious that sounds are radiated from the rear speakers placed at the real speaker positions, the virtual image orientation processing being performed according to acoustic transfer coefficients of transfer of sounds from virtual speaker positions different from the real speaker positions to the listener's ears; and supplying the sound signals processed by the virtual image orientation processing to the rear speakers.

According to this sound reproducing method, virtual image orientation processing is performed according to acoustic transfer coefficients of transfer of sounds from the rear speakers to the listener's ears when the rear speakers are placed at the virtual speaker positions.

This virtual image orientation processing is processing for enabling a sound image to be located at a position different from each of the real speaker positions, or for keeping the listener unconscious that a sound is radiated from each of the rear speakers at the real speaker positions.

Sounds processed by the virtual image orientation processing are radiated from the rear speakers at the real speaker positions, thereby weakening the listener's consciousness of the existence of the rear speakers at the real speaker positions to improve the original-sound presence in the ambiance of the reproduced sound field.

DESCRIPTION OF THE PREFERRED EMBODIMENTS

Embodiments of the present invention each provided as a sound reproducing method and an audio signal processing apparatus will be described below with reference to the accompanying drawings. In the embodiments described below, the sound reproducing method of the present invention is applied to a surround type sound reproducing system having a pair of rear speakers.

In the following description, the invention is described with respect to rear speakers whose existence is easily recognizable when the speakers radiate sound, as described above, and left and right front speakers placed in front of a listener, which also exist, will not be described. Also in the following description, an audio signal source used is assumed to be a digital video disk (DVD) reproducing unit (hereinafter referred to as "DVD unit"). For ease of explanation, the DVD unit is shown without a video signal reproducing system.

First Embodiment

Figure 1:
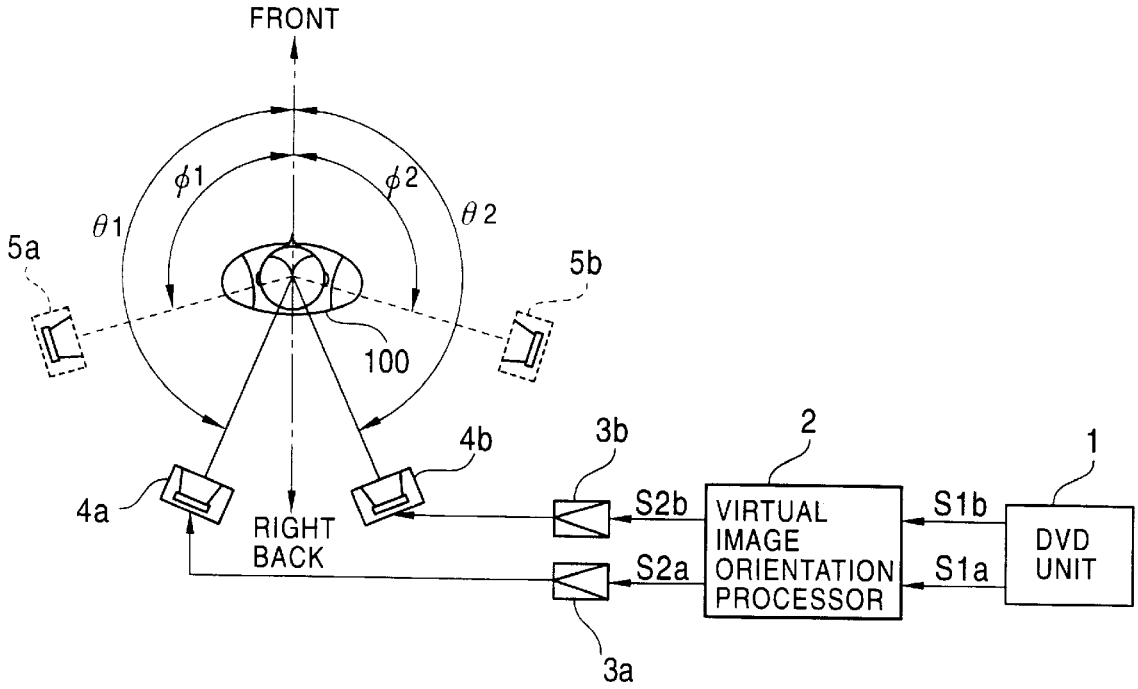
FIG. 1 is a diagram showing a sound reproducing system to which the sound reproducing method of the present invention has been applied.

FIG. 1 is a diagram showing a sound reproducing system to which the sound reproducing method in accordance with the first embodiment of the present invention has been applied.

This sound reproducing system of the first embodiment has, as shown in FIG. 1, a DVD unit 1 provided as an audio signal source for generating audio signals, a virtual image orientation processor 2 provided as an audio signal processor for performing virtual image orientation processing described below of audio signals S1*a* and S1*b* for left and right rear speakers reproduced in the DVD unit 1, amplifier circuits 3*a* and 3*b*, and a pair of rear speakers 4*a* and 4*b*. In FIG. 1, a listener 100 is also illustrated by being viewed from a position right above the listener 100, with indication of a listening position at which the listener 100 hears sounds radiated from the rear speakers 4*a* and 4*b* and a direction in which the listener 100 faces in the first embodiment.

As mentioned above, with respect to sound reproducing systems using two rear speakers, it is generally recommended that each of the angle between the direction from a listener toward a position in front of the listener and the direction from the listener toward the left rear speaker, and the angle between the direction from the listener toward the position in front of the listener and the direction from the listener toward the right rear speaker should be 110°.

In the first embodiment, however, each of the opening angle θ1 between the direction from the listener 100 toward a position in front of the listener 100 and the direction from the listener 100 toward the rear speaker 4*a* and the opening angle θ2 between the direction from the listener 100 toward the position in front of the listener 100 and the direction from the listener 100 toward the right rear speaker 4*b* is set to a value in the range from 130° to 170° which is larger than 100°.

That is, in the first embodiment, the rear speakers 4*a* and 4*b* are placed at different left and right positions about the right-back or directly behind direction from the listener 100 indicated by the dot-dash-line arrow in FIG. 1, such that the directions of the rear speakers 4*a* and 4*b* from the listener are closer to the right-back direction from the listener 100.

In the first embodiment, the rear speaker audio signals S1*a* and S1*b* reproduced in the DVD unit 1 undergoes virtual image orientation processing in the virtual image orientation processor 2 to form audio signals S2*a* and S2*b*, which are supplied to the rear speakers 4*a* and 4*b*.

This virtual image orientation processing is processing for enabling even a sound radiated from the rear speaker 4*a* or 4*b* to be imaged at a position different from the real speaker position at which the rear speaker 4*a* or 4*b* is placed, or for keeping the listener unconscious that a sound is radiated from each of the rear speakers 4*a* and 4*b* acting as real speakers.

In the first embodiment, virtual speaker positions 5*a* and 5*b* at which virtual images of the rear speakers are placed are set, as shown in FIG. 1, such that, when sounds are radiated from the rear speaker 4*a* and 4*b*, the listener 100 can have such an auditory sensation as to feel that sound images are formed at the virtual speaker positions 5*a* and 5*b*.

The virtual speaker positions 5*a* and 5*b* are set so that each of the opening angle ϕ1 between the direction from the listener 100 toward the position in front of the listener 100 and the direction from the listener 100 toward the virtual speaker position 5*a* and the opening angle ϕ2 between the direction from the listener 100 toward the position in front of the listener 100 and the direction from the listener 100 toward the virtual speaker position 5*b* is smaller than the above-described opening angle θ1 or θ2 in a horizontal plane between the position in front of the listener 100 and the rear speaker 4*a* or 4*b*.

Then, in the first embodiment, the virtual speaker positions 5*a* and 5*b* are set so that each of the opening angle ϕ1 about the listener 100 between the position in front of the listener 100 and the virtual speaker position 5*a* and the opening angle ϕ2 about the listener 100 between the position in front of the listener 100 and the virtual speaker position 5*b* is set to about 110° corresponding to the above-mentioned recommended opening angle value.

Consequently, in the first embodiment, the positions of rear speakers 4*a* and 4*b* and the virtual speaker positions 5*a* and 5*b* are set so as to satisfy both the following equations (1) and (2):

$$\text{Opening Angle } \phi 1 \approx 110^\circ \text{ (Recommended Value)} < \text{Opening Angle } \theta 1 \quad (1)$$

$$\text{Opening Angle } \phi 2 \approx 110^\circ \text{ (Recommended Value)} < \text{Opening Angle } \theta 2 \quad (2)$$

Virtual image orientation processing is performed based on sound transfer functions of transfer of sounds from the virtual speaker positions 5*a* and 5*b* to the ears of the listener 100 and sound transfer functions of transfer of sounds from the rear speakers 4*a* and 4*b* to the ears of the listener 100.

This virtual image orientation processing will be described in detail.

FIG. 2 is a diagram for explaining sound transfer functions necessary for the virtual image orientation processing performed by the virtual image orientation processor 2.

Figure 2A:
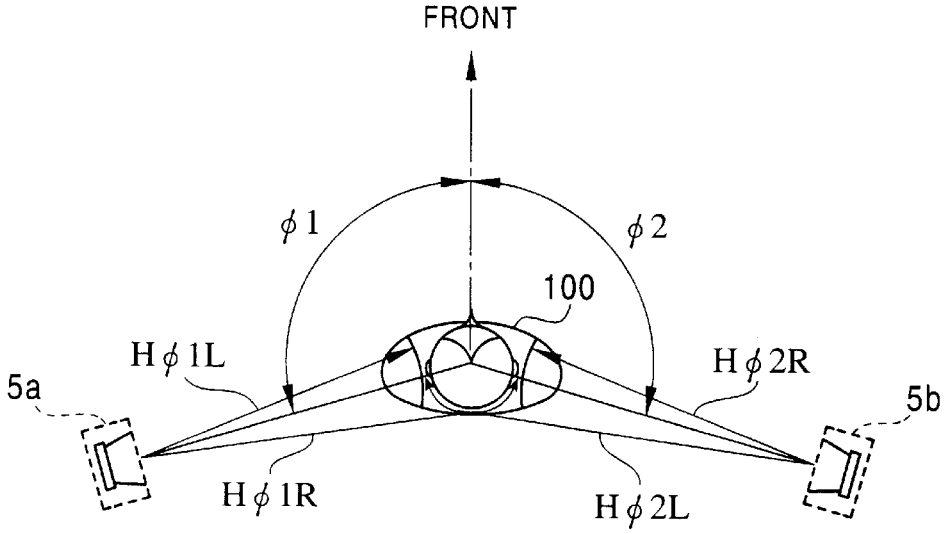
FIG. 2 is a diagram for explaining virtual image orientation processing performed in accordance with the sound reproducing method of the present invention.

As shown in FIG. 2A, the virtual image orientation processing requires an acoustic transfer function Hϕ1L of transfer of sound to the left ear of the listener 100 and an acoustic transfer function Hϕ1R of transfer of sound to the right ear of the listener 100 when a sound is radiated from the virtual speaker position 5*a* at the opening angle ϕ1, and an acoustic transfer function Hϕ2R of transfer of sound to the right ear of the listener 100 and an acoustic transfer function Hϕ2L of transfer of sound to the left ear of the listener 100 when a sound is radiated from the virtual speaker position 5*b* at the opening angle ϕ2.

Figure 2B:
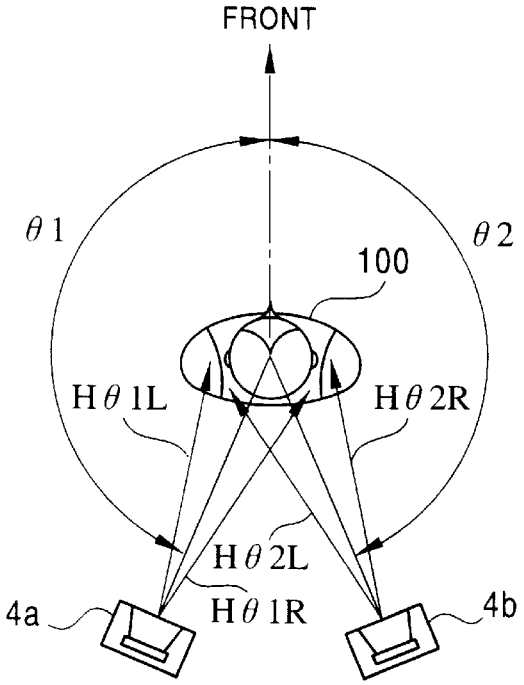

As also described below, for compensation of a crosstalk when sounds are radiated from the rear speakers 4*a* and 4*b*, the following acoustic transfer functions as shown in FIG. 2B are also required: an acoustic transfer function Hθ1L of transfer of sound to the left ear of the listener 100 and an acoustic transfer function Hθ1R of transfer of sound to the right ear of the listener 100 when a sound is radiated from the rear speaker 4*a* disposed at the opening angle θ1; and an acoustic transfer function Hθ2R of transfer of sound to the right ear of the listener 100 and an acoustic transfer function Hθ2L of transfer of sound to the left ear of the listener 100 when a sound is radiated from the rear speaker 4*b* disposed at the opening angle θ2.

These acoustic transfer functions can be obtained by placing a speaker at each of the virtual speaker positions 5*a* and 5*b* shown in FIG. 2A and the positions of rear speakers 4*a* and 4*b* shown in FIG. 2B, by causing the speaker to radiate an impulsive sound, and by measuring the impulse responses about the left and right ears of the listener 100. That is, the impulse response measured about the left or right ear of the listener 100 is the acoustic transfer function of transfer from the position of the speaker radiating the impulsive sound to the ear of the listener 100.

The virtual image orientation processor 2 performs virtual image orientation processing based on the acoustic transfer functions obtained in the above-described manner.

Figures 3, 4:
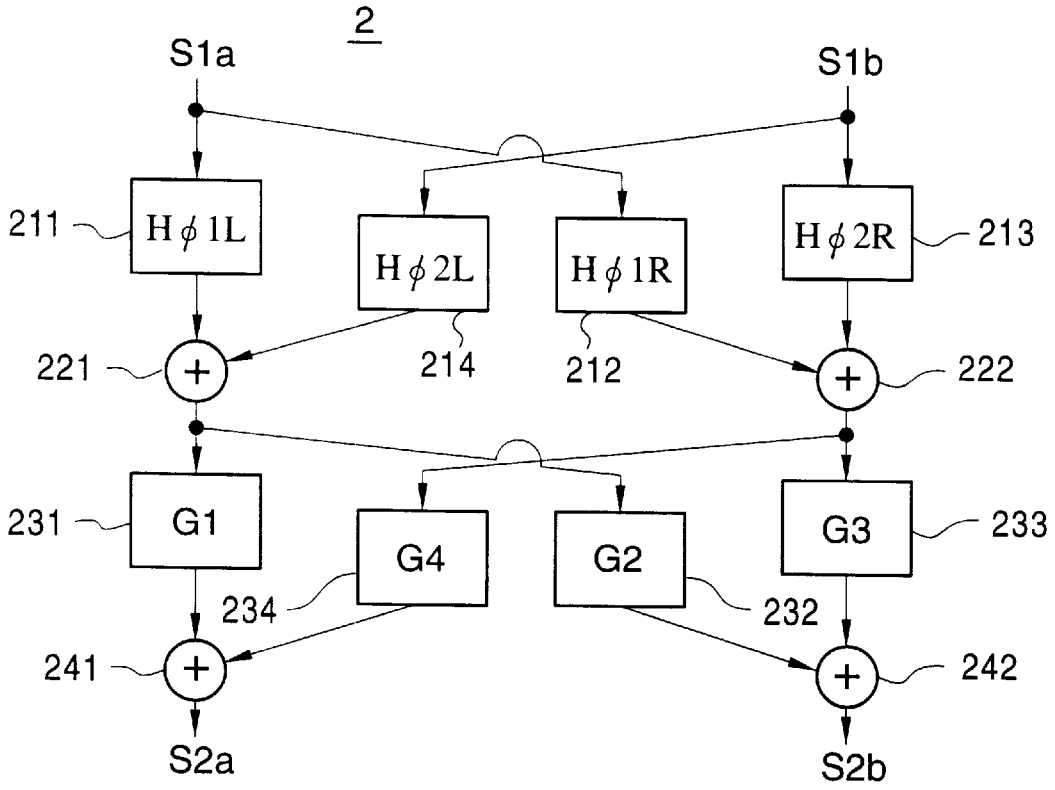
FIG. 3 is a diagram for explaining a virtual image orientation processor in the sound reproducing system shown in FIG. 1.
FIG. 4 is a table for explaining the virtual image orientation processor in the sound reproducing system shown in FIG. 1.

FIG. 3 is a block diagram for explaining the virtual image orientation processor 2 of the first embodiment. As shown in FIG. 3, the virtual image orientation processor 2 has filters 211, 212, 213, and 214 used for processing for producing binaural signals, filters 231, 232, 233, and 234 used for crosstalk compensation processing for compensating a spatial acoustic crosstalk which occurs when reproduced sounds are radiated from the rear speakers 4*a* and 4*b*, and adder circuits 221, 222, 241, and 242.

As shown in FIG. 3, the acoustic transfer functions Hϕ1L, Hϕ1R, Hϕ2R, and Hϕ2L of transfer from the virtual speaker positions 5*a* and 5*b* to the left and right ears of the listener 100 described above with reference to FIG. 2A are used as filter coefficients for the filters 211, 212, 213, and 214.

On the other hand, as shown in FIG. 4, filter coefficients G1, G2, G3, and G4 obtained on the basis of the acoustic transfer functions Hθ1L, Hθ1R, Hθ2R, and Hθ2L of transfer from the rear speakers 4*a* and 4*b* to the left and right ears of the listener 100 described above with reference to FIG. 2B are used for the filters 231, 232, 233, and 234.

Audio signal S1*a* for the left rear speaker, reproduced in the DVD unit 1 is supplied to the filters 211 and 212 of the virtual image orientation processor 2 while audio signal S1*b* for the right rear speaker is supplied to the filters 213 and 214 of the virtual image orientation processor 2.

The filters 211 and 212 change, based on the filter coefficients Hϕ1L and Hϕ1R, audio signal S1*a* to be supplied to the left rear speaker 4*a* so that a sound image corresponding to a sound radiated from the left rear speaker 4*a* and imaged by the listener is located at the virtual speaker position 5*a* or on the virtual speaker position 5*a* side.

Similarly, the filters 213 and 214 change, based on the filter coefficients Hϕ2R and Hϕ2L, audio signal S1*b* to be supplied to the right rear speaker 4*b* so that a sound image corresponding to a sound radiated from the right rear speaker 4*b* and imaged by the listener is located at the virtual speaker position 5*b* or on the virtual speaker position 5*b* side.

The audio signals processed by the filters 211 and 214 to be sensed by the left ear of the listener 100 are supplied to the adder circuit 221 while the audio signals processed by the filters 212 and 213 to be sensed by the right ear of the listener 100 are supplied to the adder circuit 222.

An audio signal obtained by processing in the adder circuit 221 is supplied to the filters 231 and 232 while an audio signal obtained by processing in the adder circuit 222 is supplied to the filters 233 and 234.

The filters 231, 232, 233, and 234 perform processing for canceling a crosstalk according to the filter coefficients G1, G2, G3, and G4 obtained on the basis of the acoustic transfer functions of transfer from the rear speakers 4*a* and 4*b* to the ears of the listener 100. The audio signals processed by the filters 231 and 234 are supplied to the adder circuit 241 while the audio signals processed by the filters 232 and 233 are supplied to the adder circuit 242.

The adder circuit 241 outputs audio signal S2*a* which is supplied to the left rear speaker 4*a*, and from which, when a corresponding sound is radiated form the left rear speaker 4*a*, a sound image imaged by the listener is located on the virtual speaker position 5*a* side. On the other hand, the adder circuit 242 outputs audio signal S2*b* which is supplied to the right rear speaker 4*b*, and from which, when a corresponding sound is radiated from the right rear speaker 4*b*, a sound image imaged by the listener is located on the virtual speaker position 5*b* side.

Thus, even when sounds corresponding to audio signals for the rear speakers 4*a* and 4*b* are radiated from the rear speakers 4*a* and 4*b*, the listener can have an auditory sensation of the radiated sounds such that sound images are formed at the virtual speaker positions 5*a* and 5*b* or on the virtual speaker position 5*a* side and on the virtual speaker position 5*b* side.

As a result, an undesirable feeling relating to the existence of the rear speakers represented by a feeling of lack of spacing from the sound sources can be prevented and sounds radiated from the rear speakers can be sensed as more naturally, thus improving the desirable ambiance and presence to be obtained with sounds radiated from the rear speakers.

In the first embodiment described above, even if virtual image orientation processing is performed by the virtual image orientation processor 2 using filters having filter coefficients obtained on the basis of acoustic transfer functions measured about the ears of a listener, it is difficult to maintain accurate reproductivity, and the possibility of occurrence of an image orientation error (sound image blur) is high. In particular, in the case where a virtual sound image is formed by setting virtual speaker positions 5*a* and 5*b* outside the rear speakers 4*a* and 4*b* acting as real speakers from which sounds are actually radiated, the sound image has a marked tendency to shift from the oriented point.

Therefore, when sounds corresponding to audio signals processed by virtual image orientation processing are radiated from the rear speakers 4*a* and 4*b*, the radiated sounds are liable to have such an image quality as to make a listener to feel that a sound image is wafting in the air. This is supposed to be a factor of the result that the listener's consciousness of the existence of the rear speakers is weakened.

If the directions of the rear speakers (sound sources) 4*a* and 4*b* and the directions of sensation of sound images are set different from each other as described above, a sound image can easily be formed separately from the sound sources due to the influence of reflected sounds from walls or the like of the room in which sounds are radiated, so that the sounds radiated from the rear speakers 4*a* and 4*b* are liable to have such an image quality as to make a listener to feel that a sound image is wafting in the air. This effect is also supposed to contribute to the result that the listener's consciousness of the existence of the rear speakers is weakened.

Audio signals for causing sounds radiated from the rear speakers 4*a* and 4*b* may be formed by the virtual image orientation processor 2 performing virtual image orientation processing using filters with filter coefficients prepared on the basis of typical head acoustic transfer functions, e.g., those obtained by measurements with respect to a multiplicity of testees.

In such a case, there is a possibility of the acoustic transfer functions used being different from those measured about the ears of the listener 100. In such a situation, some image orientation error occurs with respect to an image perceived by the listener 100. This is supposed to contribute to the result that the listener's consciousness of the existence of the rear speakers is weakened.

That is, as mentioned above, it is difficult to maintain accurate reproductivity even if acoustic transfer functions measured about the ears of a listener who actually hears sounds from rear speakers 4*a* and 4*b* are used. Therefore, the ambiance and presence required with respect to sounds radiated from the rear speakers are not considerably reduced by a change of the listening position or changes in the acoustic transfer functions variable with respect to a plurality of listeners if such changes are not extremely large.

In the first embodiment described above, the filter coefficients of the filters shown in FIG. 3 are prepared with respect to a speaker layout in which each of the pair of virtual speaker positions 5*a* and 5*b* and the pair of rear speakers (real speaker positions) 4*a* and 4*b* are not substantially symmetrical about the front-rear axis on a listener.

If each of the pair of virtual speaker positions 5*a* and 5*b* and the pair of rear speakers (real speaker positions) 4*a* and 4*b* are substantially symmetrical about the front-rear axis on a listener, a shuffler type filter may be used to simplify the configuration of the virtual image orientation processor 2.

Second Embodiment

The sound reproducing method in accordance with the second embodiment of the present invention will next be described. In a sound reproducing system of the second embodiment, a plurality of virtual speaker positions are set with respect to two rear speakers 4*a* and 4*b* to further improve the ambiance of a rear (surround) sound field.

Figure 5:
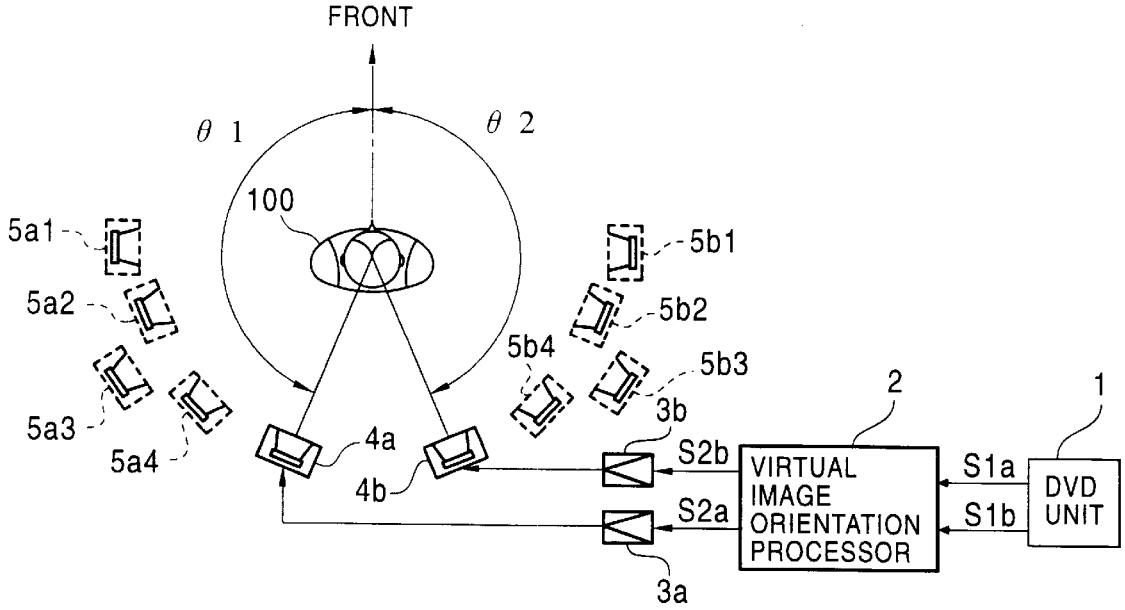
FIG. 5 is a diagram for explaining a sound reproducing system to which another example of the sound reproducing method of the present invention has been applied.

FIG. 5 is a diagram for explaining the sound reproducing system of the second embodiment. As shown in FIG. 5, the sound reproducing system of the second embodiment has the same configuration as the above-described sound reproducing system of the first embodiment except that a plurality of virtual speaker positions 5*a*1 to 5*a*4, and 5*b*1 to 5*b*4 are set in relation to rear speakers 4*a* and 4*b*.

Since the plurality of virtual speaker positions are set in different places, coefficients for filters forming the virtual image orientation processor 2 and used in processing for obtaining binaural signals are different from those described above with respect to the first embodiment.

In the second embodiment, since, as shown in FIG. 5, the virtual speaker positions 5*a*1 to 5*a*4, or 5*b*1 to 5*b*4 are set in four places in relation to each of the rear speaker 4*a* and 4*b*, filter coefficients in processing for obtaining binaural signals are determined by considering a plurality of acoustic transfer functions of transfer from the plurality of virtual speaker positions to the ears of a listener.

Figures 6, 7:
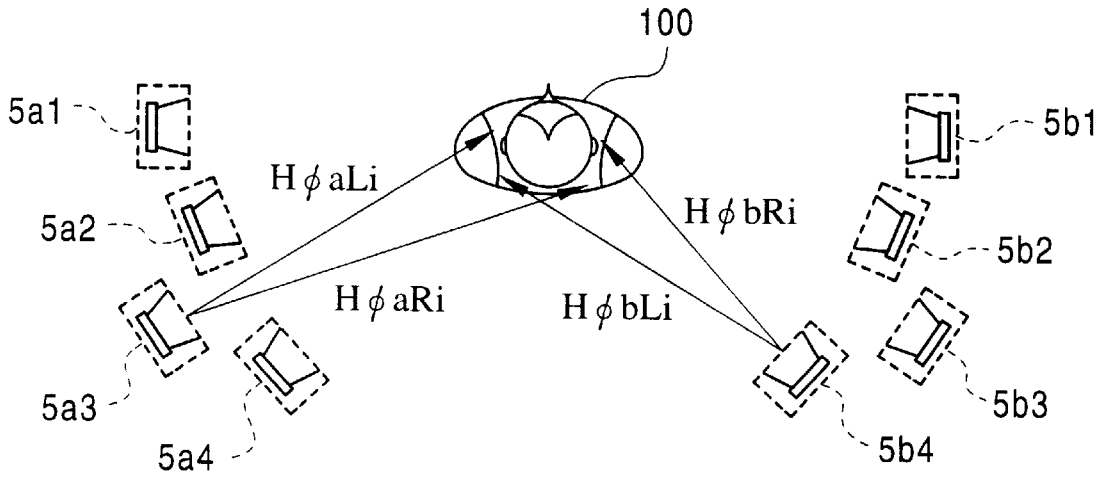
FIG. 6 is a diagram for explaining virtual image orientation processing in accordance with the sound reproducing method relating to the sound reproducing system shown in FIG. 5.
FIG. 7 is a table for explaining virtual image orientation processing in accordance with the sound reproducing method elating to the sound reproducing system shown in FIG. 5.

The acoustic transfer functions of transfer from each of the virtual speaker positions to the left and right ears of the listener 100 can be obtained by placing a speaker at the virtual speaker position, as shown in FIG. 6, causing the speaker to radiate an impulsive sound, and measuring impulse responses about the left and right ears of the listener 100.

In the case where the plurality of virtual speaker positions are set in this manner, the acoustic transfer functions of transfer from the plurality of virtual speaker positions to each of the left and right ears of the listener 100 are added to form one acoustic transfer function to the left or right ear of the listener 100.

That is, an acoustic transfer function H1 of transfer from the virtual speaker positions 5*a*1, 5*a*2, 5*a*3, and 5*a*4 on the left-hand side of the listener 100 to the left ear of the listener 100 and an acoustic transfer function H2 of transfer from these virtual speaker positions to the right ear are obtained as shown by the following equations (3) and (4):

$$H1=H\phi aL1+H\phi aL2+H\phi aL3+H\phi aL4 \quad (3)$$

$$H2=H\phi aR1+H\phi aR2+H\phi aR3+H\phi aR4 \quad (4)$$

Similarly, an acoustic transfer function H3 of transfer from the virtual speaker positions 5*b*1, 5*b*2, 5*b*3, and 5*b*4 on the right-hand side of the listener 100 to the right ear of the listener 100 and an acoustic transfer function H4 of transfer from these virtual speaker positions to the left ear are obtained as shown by the following equations (5) and (6):

$$H3=H\phi bR1+H\phi bR2+H\phi bR3+H\phi bR4 \quad (5)$$

$$H4=H\phi bL1+H\phi bL2+H\phi bL3+H\phi bL4 \quad (6)$$

Thus, the acoustic transfer functions H1, H2, H3, and H4 with respect to the left and right ears of the listener 100 in this case can be obtained as shown in FIG. 7, with i representing the number attached as a suffix to each of HφaL, HφaR, HφbL, and HφbR in the above equations.

Figure 8:
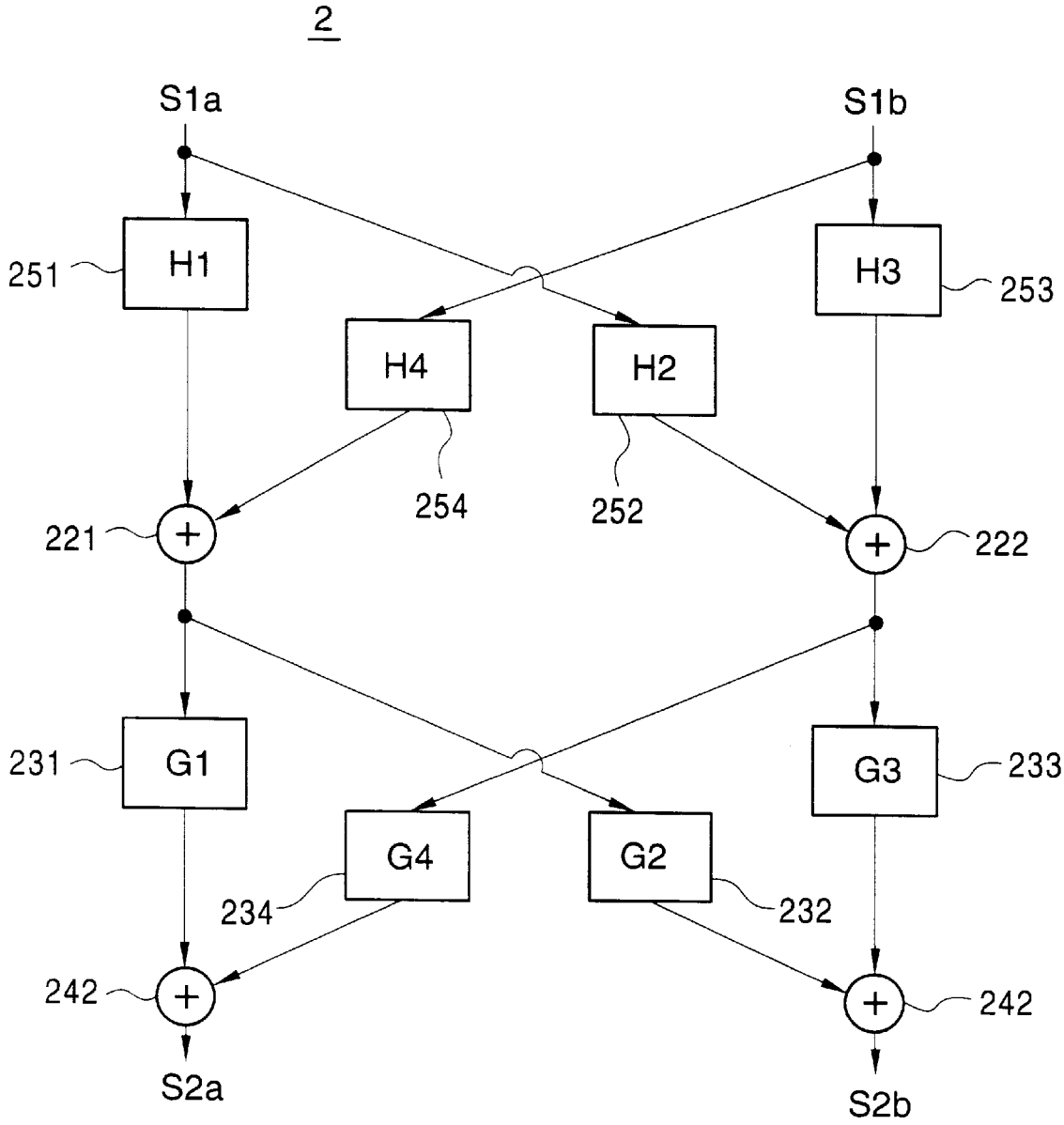
FIG. 8 is a diagram for explaining a virtual image orientation processor in the sound reproducing system shown in FIG. 5.
Figure 9:
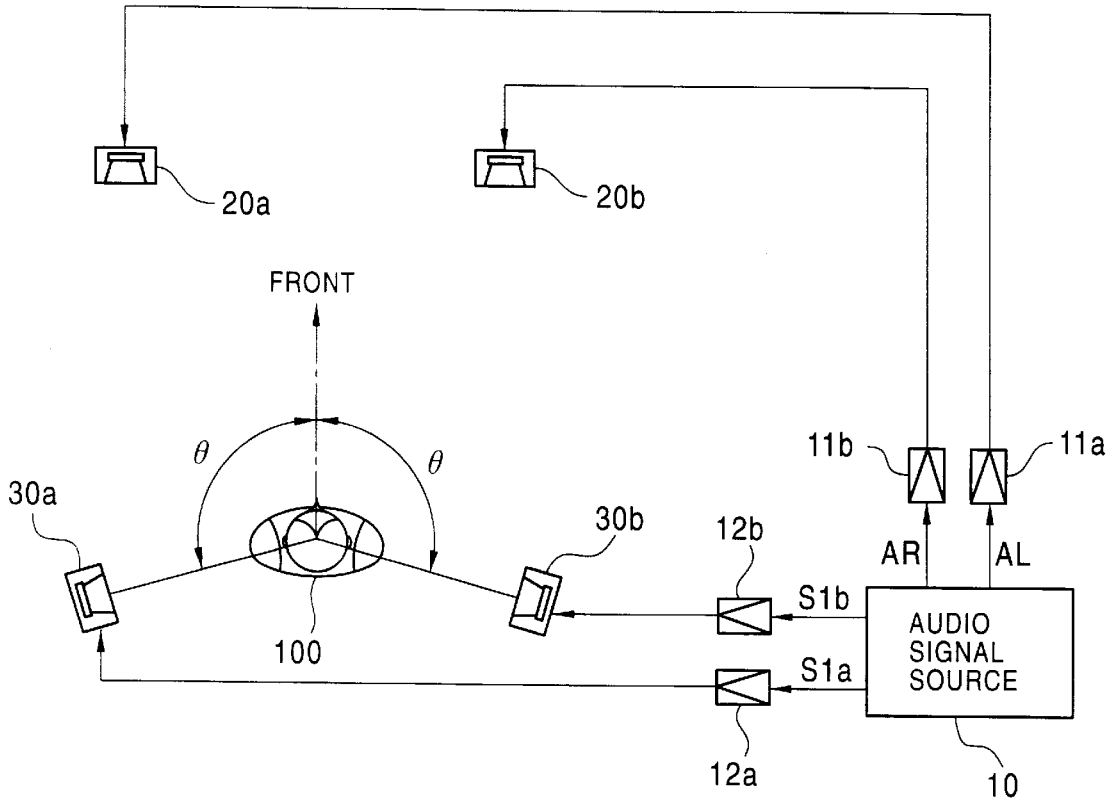
FIG. 9 is a diagram showing a conventional sound reproducing system using rear speakers.

In the second embodiment, as shown in FIG. 8, the virtual image orientation processor 2 is formed by using filters 251 to 254 having filter coefficients represented by the acoustic transfer functions H1, H2, H3, and H4 obtained with respect to the plurality of virtual speaker positions 5*a*1 to 5*a*4, and 5*b*1 to 5*b*4.

In this case, the filter 251 uses, as a filter coefficient, the acoustic transfer function H1 of transfer from the virtual speaker positions 5*a*1, 5*a*2, 5*a*3, and 5*a*4 on the left-hand side of the listener 100 shown in FIG. 6 to the left ear of the listener 100 while the filter 252 uses, as a filter coefficient, the acoustic transfer function H2 of transfer from the virtual speaker positions 5*a*1, 5*a*2, 5*a*3, and 5*a*4 on the left-hand side of the listener 100 shown in FIG. 6 to the right ear of the listener 100.

Similarly, the filter 253 uses, as a filter coefficient, the acoustic transfer function H3 of transfer from the virtual speaker positions 5*b*1, 5*b*2, 5*b*3, and 5*b*4 on the right-hand side of the listener 100 shown in FIG. 6 to the right ear of the listener 100 while the filter 252 uses, as a filter coefficient, the acoustic transfer function H4 of transfer from the virtual speaker positions 5*b*1, 5*b*2, 5*b*3, and 5*b*4 on the right-hand side of the listener 100 shown in FIG. 6 to the left ear of the listener 100.

If a plurality of virtual speaker positions are set, the reproduced sound field can be approximated to the sound field at the time of mixing of audio signals (sources) to obtain more natural sound field feeling and to further improve the ambiance of the surround sound field.

In the second embodiment, virtual speaker positions (virtual images) are spread to left four places and to right four places at the rear of listener 100. However, a smaller or larger number of virtual speaker positions may alternatively be set to spread virtual images, for example, to left two, three, five or six places and to right two, three, five or six places.

In the above-described first and second embodiments, virtual speaker positions (virtual images) are set at angles within the opening angles θ1 and θ2 between the direction from listener 100 toward a position in front of listener 100 and the directions from listener 100 toward rear speakers 4*a* and 4*b*. However, the present invention is not limited to this arrangement.

For example, the opening angles θ1 and θ2 between the direction from listener 100 toward a position in front of listener 100 and the directions from listener 100 toward real speakers 4*a* and 4*b* are set to an angle of about 110° corresponding to the above-mentioned value (angle) recommended with respect to sound reproducing systems using two rear speakers, and virtual speaker positions may be set outside real speakers 4*a* and 4*b*.

That is, virtual speaker positions may be set so that each of the opening angles $\phi 1$ and $\phi 2$ between the direction from listener 100 toward a position in front of listener 100 and the directions from listener 100 toward the virtual speaker positions is larger than the opening angle $\theta 1$ or $\theta 2$. Further, at least two pairs of virtual speaker positions may be set at different opening angles $\phi 1$ and $\phi 2$ selected in such a manner that smaller ones of the opening angles $\phi 1$ and $\phi 2$ are smaller than the opening angles $\theta 1$ and $\theta 2$ while larger ones of the opening angles $\phi 1$ and $\phi 2$ are larger than the opening angles $\theta 1$ and $\theta 2$.

Thus, rear speakers 4*a* and 4*b* can be set at any real speaker positions at the rear of listener 100. Needless to say, virtual speaker positions can be set at positions arbitrarily selected.

The virtual image orientation processor 2 of the above-described first and second embodiments has been described as a unit separate from the DVD unit 1 provided as a sound signal source. However, the arrangement may alternatively be such that, for example, a similar virtual image orientation processor is incorporated in a reproducing apparatus such as a DVD unit provided as an audio signal source or in an audio amplifier unit.

In the above-described first and second embodiments, sound signals S1*a* and S1*b* not processed by virtual image orientation processing may be partly mixed in the signals at rear speakers 4*a* and 4*b* disposed as real speakers as shown in FIG. 1 or 5.

That is, if virtual images are spread by setting virtual speaker positions outside rear speakers 4*a* and 4*b* as shown in FIG. 1 or 5, audio signals S1*a* and S1*b* for the rear speakers before virtual image orientation processing may be partly mixed in the signals at rear speakers 4*a* and 4*b* disposed in directions from the listener close to the right-back direction from the listener. It has been confirmed by a comparative hearing experiment that, even in such a case, improved naturality of the sound field and improved ambiance are not impaired.

Each of the first and second embodiments of the present invention has been described as a sound reproducing system using a DVD unit as a sound signal source. However, the present invention is not limited to this. The present invention can also be applied to other sound reproducing systems using, as a sound source, reproducing units for reproduction from various audio signal recording mediums, e.g., small magneto-optical disks called compact disk (CD) and mini disk (MD).

Needless to say, the present invention can be applied to a so-called home theater system or the like, in which sounds corresponding to an audio signal reproduced from a video tape recorder are radiated from rear speakers disposed at the rear of a listener as well as front speakers to enable the listener at home to enjoy a video picture with movie-theater presence.

Thus, the present invention can be applied to various systems in which sound corresponding to rear speaker sound signals are output from at least one pair of left and right rear speakers.

The number of rear speakers in a sound reproducing system to which the present invention is applied is not limited to two, and the present invention can also applied to a system having a plurality of rear speakers. In such a case, virtual image orientation processing of audio signals for sound radiation from rear speakers may be performed based on acoustic transfer functions of transfer from the assumed virtual speaker positions to the ears of a listener.

The present invention can also be applied to car audio systems used in motor vehicles and to large-scale sound reproducing systems for concert halls, theaters, movie theaters and the like as well as to home audio systems.

According to the present invention, as described above, the problem relating to the listener's consciousness of the existence of rear speakers can be solved, thereby enabling radiated sound to be perceived as a natural sound and improving the ambiance of a sound field even when rear speakers are used.

What is claimed is:

1. A method of reproducing sound comprising the steps of:

providing only two real rear speakers located behind a listener;

deriving acoustic transfer coefficients representing transfer of sounds to a listener's ears from predetermined virtual speaker positions different from actual speaker positions;

performing virtual image orientation processing on rear surround sound signals supplied to said two real rear speakers, located behind said listener and being arranged close to a line passing from front to back through said listener, using said acoustic transfer coefficients derived in said deriving step so that said listener perceives a sound image originating from a position different from a position of each real rear speaker; and supplying said rear surround sound signals processed by said virtual image orientation processing to said two real rear speakers located behind said listener.

2. The method according to claim 1, wherein said real rear speakers are positioned such that an opening angle between the front of a listener and said rear speakers is larger than 110°.

3. The method of reproducing sound according to claim 2 wherein said virtual image orientation processing step includes positioning said virtual speakers at opening angles of substantially 110° from the front of said listener.

4. A method of reproducing sound comprising the steps of:

providing only two real rear speakers located behind a listener;

deriving acoustic transfer coefficients representing transfer of sounds to a listener's ears from predetermined virtual speaker positions different from actual speaker positions;

performing virtual image orientation processing on rear surround sound signals supplied to said two real rear speakers, located behind said listener and being arranged close to a line passing from front to back through said listener, using said acoustic transfer coefficients derived in said deriving step so that said listener is unaware that sounds are radiated from said two real rear speakers placed at their actual speaker positions; and supplying said rear surround sound signals processed by said virtual image orientation processing to said two real rear speakers behind said listener.

5. The method of reproducing sound according to claim 4, wherein said real rear speakers are positioned such that an opening angle between the front of said listener and said real rear speakers is larger than 110°.

6. The method of reproducing sound according to claim 5 wherein said virtual image orientation processing step includes positioning said virtual speakers at opening angles of substantially 110° from the front of said listener.

7. An apparatus for processing audio signals using acoustic transfer coefficients representing transfer of sounds to a listener's ears from predetermined virtual speaker positions different from actual speaker positions, the apparatus comprising:

only two real rear speakers located behind a listener;

an input terminal through which reproduced rear surround audio signals from an audio signal source for said two real rear speakers are input, with said two real rear speakers located behind said listener and being arranged close to a line passing from front to back through said listener;

a virtual image orientation processing section for processing said rear surround audio signals using said acoustic transfer coefficients derived for said two real rear speakers input through said input terminal so that said listener perceives a sound image originating from a position different from the actual real rear speaker position; and an output terminal through which said rear surround audio signals for said real rear speakers processed by said virtual image orientation processing section are output to said two real rear speakers located behind said listener.

8. The apparatus according to claim 7, wherein said real rear speakers are placed at positions such that the opening angle between the front of said listener and said real rear speakers is larger than 110°.

9. The apparatus according to claim 8, wherein said virtual image orientation processing section sets virtual speakers at positions of opening angles of substantially 110° from the front of said listener.

10. An apparatus for processing audio signals using acoustic transfer coefficients representing transfer of sounds to a listener's ears from predetermined virtual speaker positions that are different from the actual speaker positions, the apparatus comprising:

only two real rear speakers located behind a listener;

an input terminal through which reproduced rear surround audio signals from an audio signal source for said two real rear speakers are input, with said two real rear speakers located behind said listener and being arranged close to a line passing from front to back through said listener;

a virtual image orientation processing section for processing said rear surround audio signals using said acoustic transfer coefficients derived for said two real rear speakers input through said input terminal so that said listener is unaware that sounds are radiated from said two real rear speakers placed at their actual speaker positions behind said listener; and an output terminal through which said rear surround audio signals for said real rear speakers processed by said virtual image orientation processing section are output.

11. The apparatus according to claim 10 wherein real rear speakers are placed at positions such that the opening angle between the front of said listener and said rear speakers is larger than 110°.

12. The apparatus according to claim 11 wherein said virtual image orientation processing section sets virtual speakers at positions of opening angles of substantially 110° from the front of said listener.

* * * * *